US005992509A

United States Patent [19]

Fennesz

[11] Patent Number: 5,992,509

[45] **Date of Patent: *Nov. 30, 1999**

[54] BASEBOARD HEATING WITH A WOODEN COVER

[76] Inventor: Manfred Fennesz, Hartlebengasse 1-17/51/1, A-1220 Vienna, Austria

[ * ] Notice: This patent is subject to a terminal disclaimer.

[21] Appl. No.: 08/201,970

[22] Filed: Feb. 23, 1994

Related U.S. Application Data

[63] Continuation-in-part of application No. PCT/EP92/01911, Aug. 20, 1992, abandoned.

[30] Foreign Application Priority Data

Aug. 23, 1991 [AT] Austria ..... 1656/91

[51] Int. Cl.[6] ..... F24H 3/00; F24H 9/06

[52] U.S. Cl. ..... 165/55; 165/67; 165/81

[58] Field of Search ..... 165/55, 67, 81, 165/82; 237/79

[56] References Cited

U.S. PATENT DOCUMENTS

| | | | |
|---|---|---|---|
| 2,487,287 | 11/1949 | Weber et al. | 237/79 X |
| 2,696,368 | 12/1954 | Edwards | 165/55 |
| 3,448,795 | 6/1969 | McNabney | 165/67 X |

FOREIGN PATENT DOCUMENTS

| | | | |
|---|---|---|---|
| 1398332 | 5/1964 | France | 165/55 |
| 2148097 | 5/1985 | United Kingdom | 165/67 |

*Primary Examiner*—Leonard R. Leo

[57] ABSTRACT

The invention relates to a baseboard heating means having a cover (13) which is hindered as little as possible by a retaining system (27, 28) in any longitudinal changes and is nevertheless held securely. The system is distinguished by good self-construction characteristics and is practical to use.

17 Claims, 11 Drawing Sheets

BASEBOARD HEATING WITH A WOODEN COVER

This is a Continuation in Part of International Application PCT/EP92/01911, with an international filing date of Aug. 20, 1992, now abandoned.

The invention relates to a baseboard heating means having a wooden cover.

Conventional baseboard heating means having wooden cladding or the like have a frame or support parts to which wooden front covers are screwed. Furthermore, an inner, upper and, in part, lower facing is likewise fixed with visible screws. The heat exchanger—conventionally consisting of at least one pipe with radial lamellae—is held by a solid wooden part after removal of many lamellae or is placed on horizontal boards or support parts (lower facing). A disadvantage is that it is necessary to provide the underneath of the heat exchanger with plastic rails to avoid transmitting noises during thermal expansions directly to the support part. However, these plastic rails block convection in their region.

A further disadvantage of known designs is their rigid installation. Simply to remove the cover, it is necessary completely to unscrew wood screws and to screw them in again for mounting, which gives rise to the danger of injury. However, such designs should be cleaned at least every year or every second year, and it is therefore the object of the invention to provide a design which is invisibly fastened and can be rapidly and simply dismantled and in which the cover need not be mounted on support parts. Furthermore, the invention should allow play for longitudinal expansion of the wooden cover, something which was previously impossible owing to the rigid screw connection. However, the stability of the baseboard heating in general should be ensured. All these objects are achieved by the use of the features of claim 1.

The fastening surface is, for example, doubled without convection being hindered. Owing to the design of the clips and the retaining bracket, it is possible also to retain two abutting covers in order linearly to compensate expansions or shrinkages of the wooden covers. Vertical shrinkages and expansions can be compensated by means of springs on the fastening part. When viewed from the front, all parts are invisibly fastened. The movable insert part in the inner clip is displaceable and retains heat exchangers or pipes in a relatively flexible manner. It also permits the fastening of different heat exchangers, square, round, etc. Air disturbance lamellae, support parts for blow-off grids, rigid spoiler lamellae and covers for inlet and outlet pipes of the heating strips may then also be fastened. Air grids or adjustable spoiler lamellae are suitable as an alternative to an upper flat cover, which can be mounted on the clips.

Further embodiments of the invention are described in the dependent claims. The resulting advantages all ensure mounting which is as simple as possible but safe, especially by the self-construction method. The visual impression of the heating strip according to the invention is not impaired by any fastening means.

Further advantageous embodiments and variants are evident from the description of the Figures. The embodiments shown in the Figures illustrate preferred, but not exclusive variants.

Figure 6:
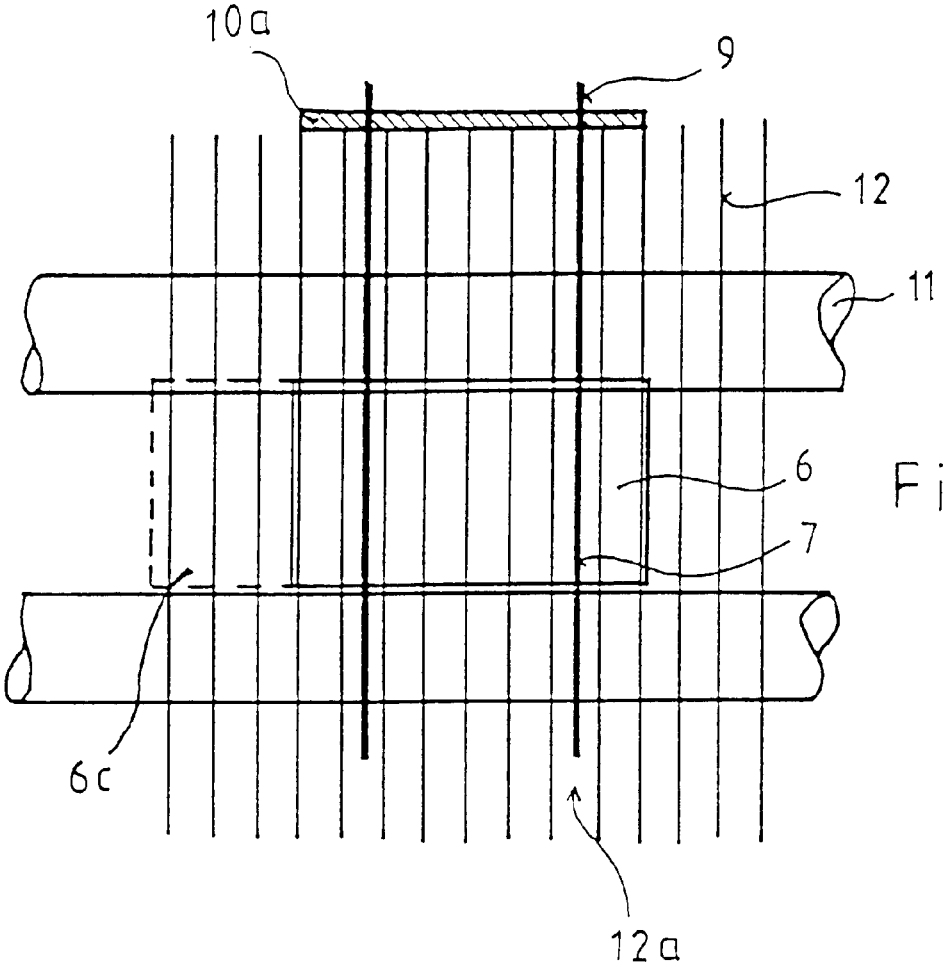
FIG. 6 shows a heat exchanger element in a view with the wooden cover removed.
Figure 6A:
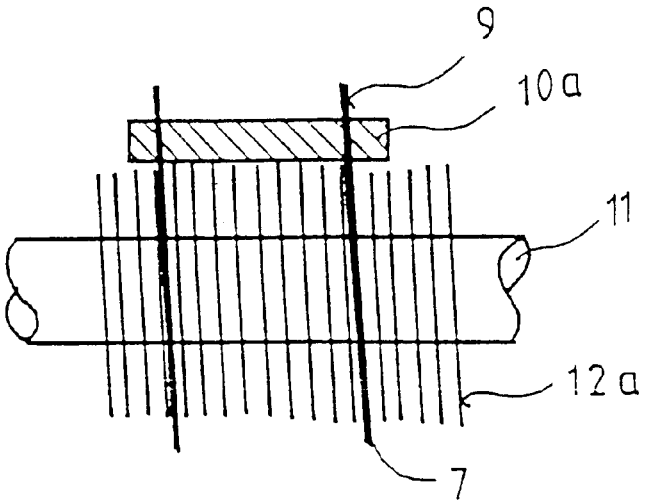
Figure 7:
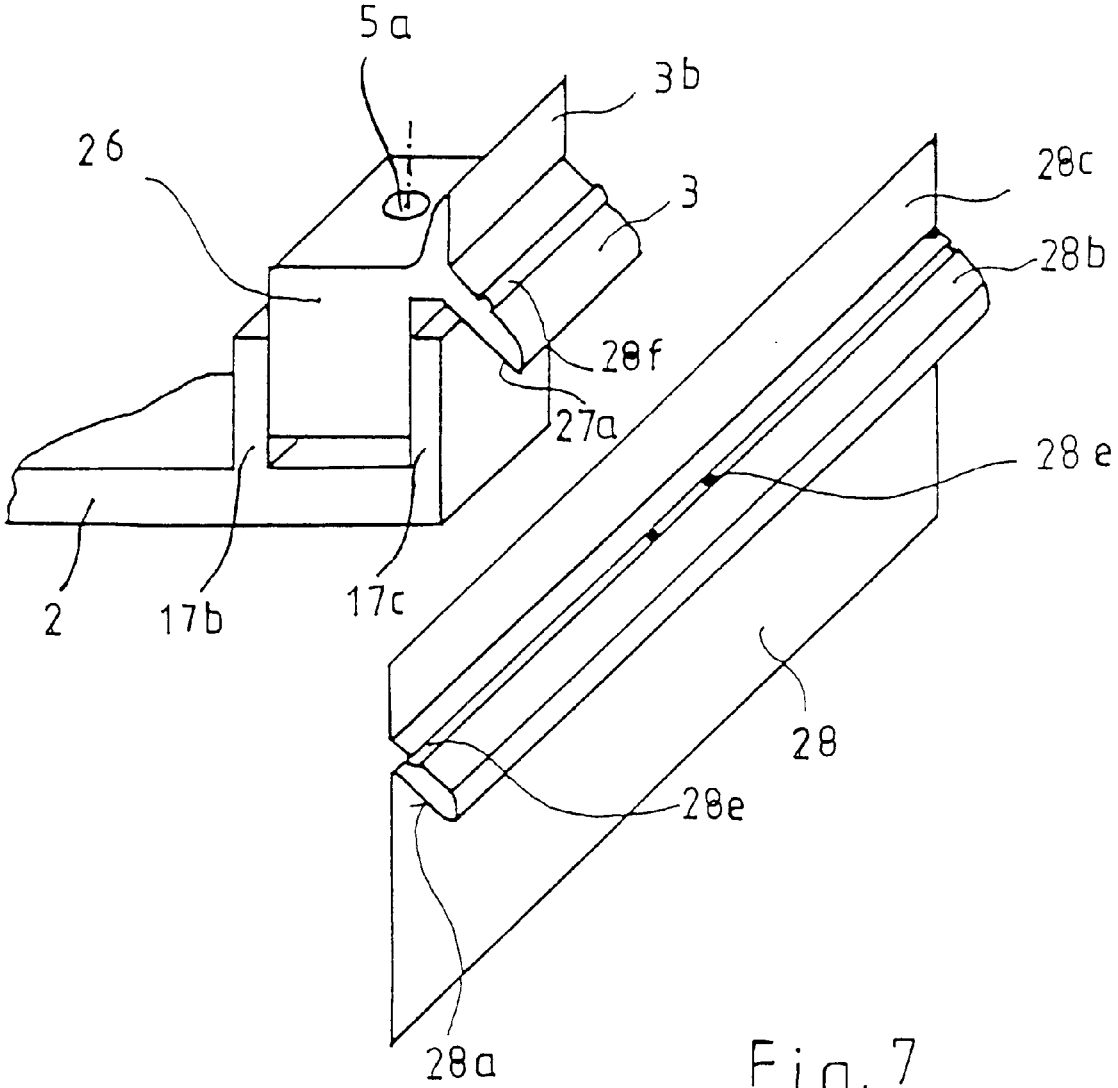
Figure 8:
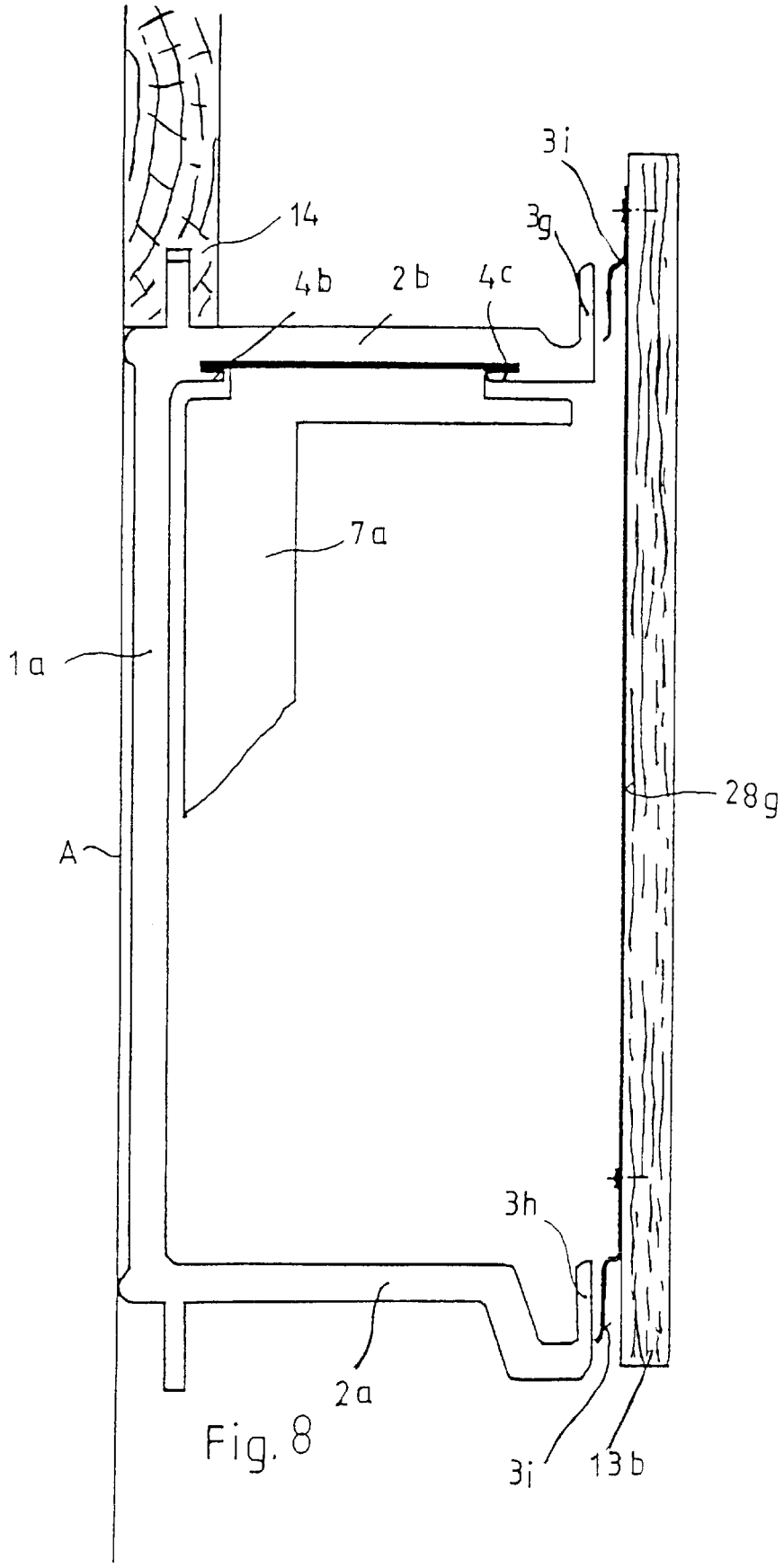
Figure 13:
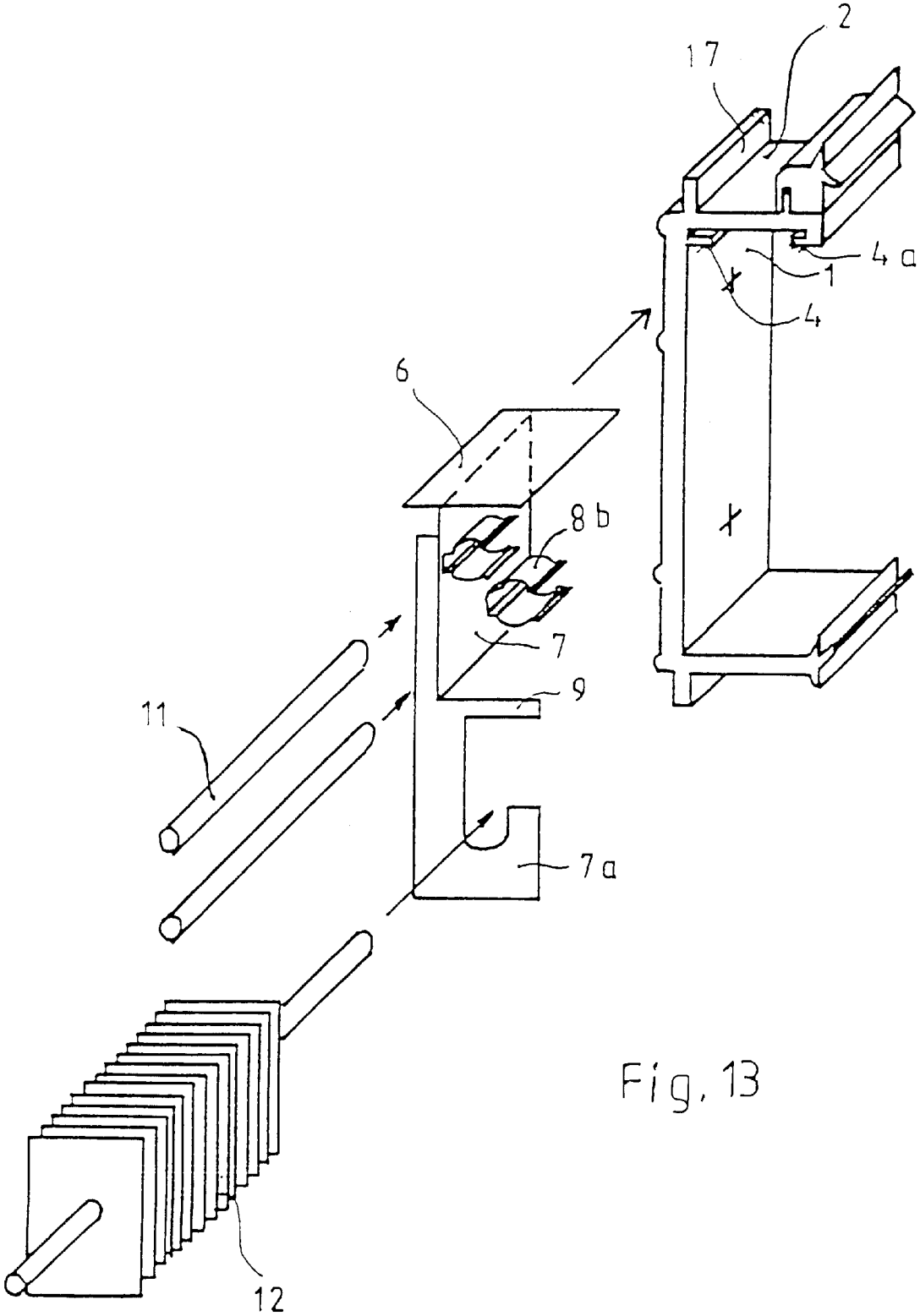
Figure 14:
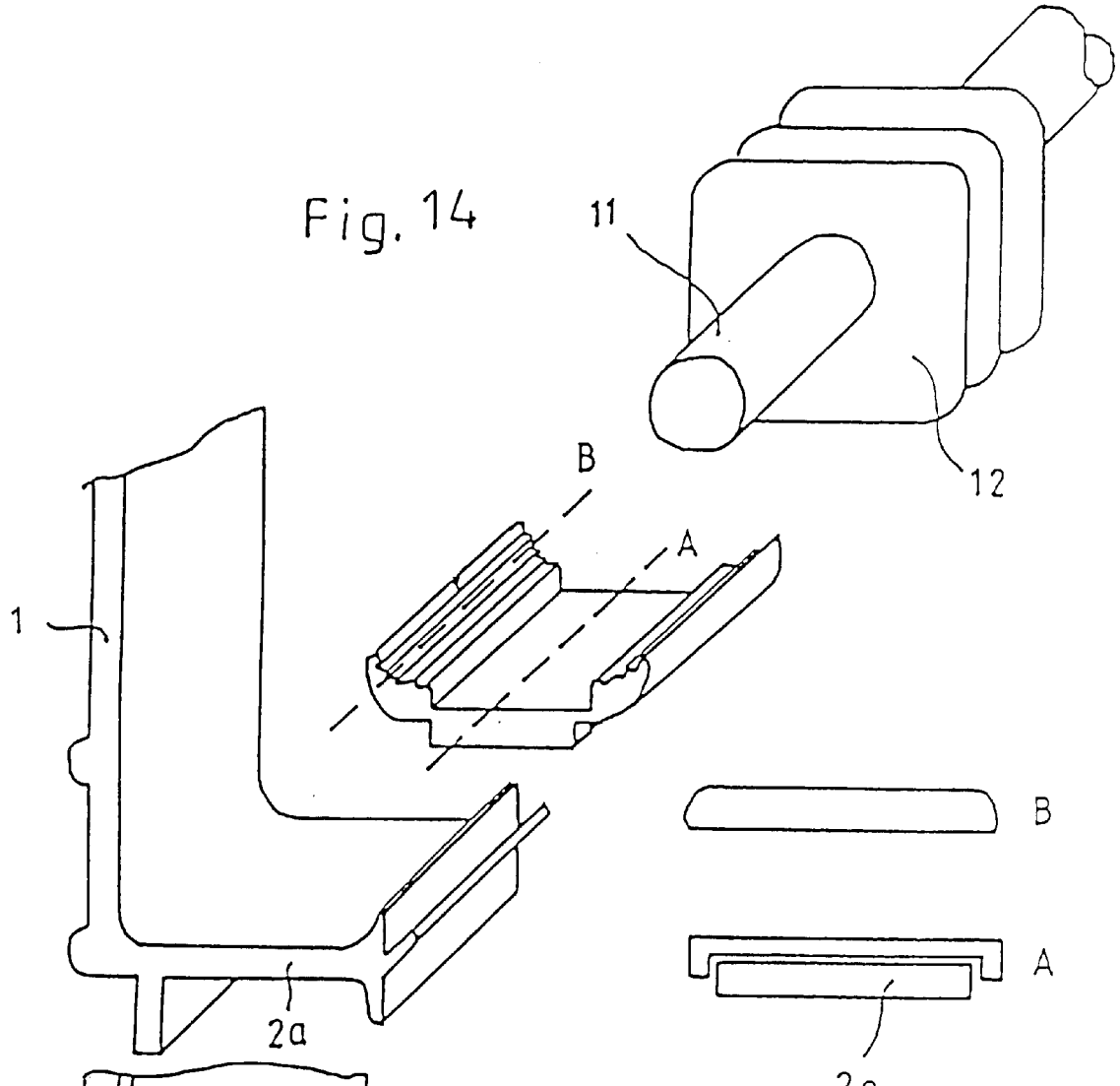
Figure 15:
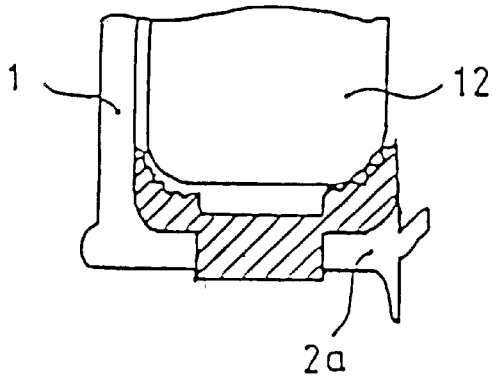

FIG. 6*a* shows a variant of this;

FIG. 7 shows an exploded view of a detail of the fastening;

FIG. 8 shows a section through a detail of a retaining clip;

FIGS. 9–12 show details of different retaining clip variants;

FIG. 13 shows a variant with a special retaining part and

FIGS. 14–17 show special embodiments of the heat exchanger.

The Figures partly supplement one another. Identical parts bear identical reference symbols.

Figure 1:
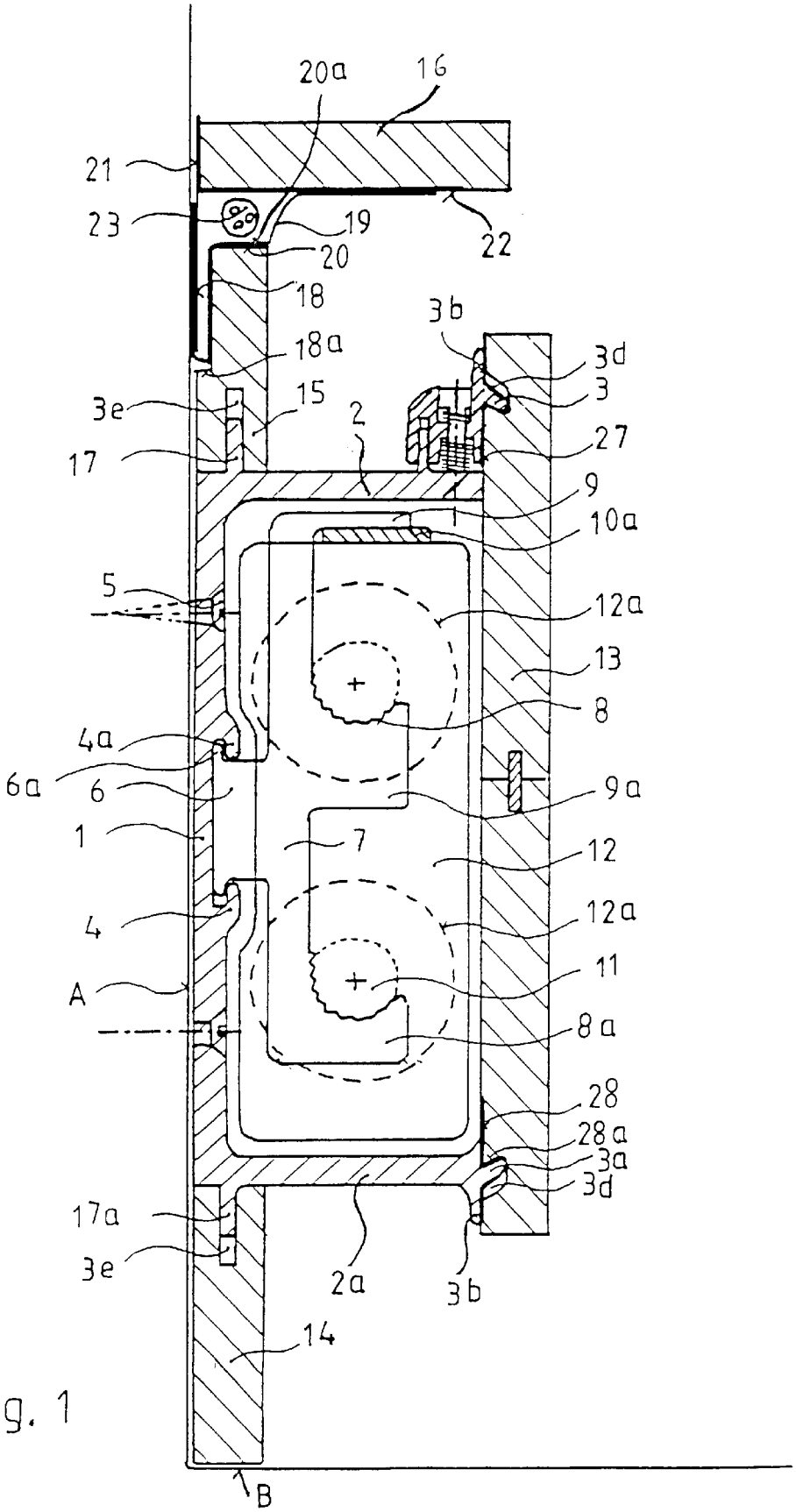
FIG. 1 shows a section through a heating strip according to the invention, in the mounted state.

FIG. 1 shows the structure of a baseboard heating or cooling means. A wall fastening part 1 having a narrow upper arm 2 and an upper hook 3 and a narrow lower arm 2*a* and a lower hook 3*a*, of which at least one hook 3 is movable, is shown. The hooks 3, 3*a* may point inward or outward or both may point upward. The hooks 3 and 3*a* grip a wooden front cover 13 which, in exceptional cases, may also consist of metal, stone, ceramic, plastic, artificial stone and other materials. The lower hook 3*a* has an enlarged 3-point support surface 3*b* and 3*c*, and the upper hook 3 has an enlarged 3-point support surface 3*b* and 27. The wall fastening part 1 has two extensions 4 and 4*a* on the inside. It is also possible to provide one extension 4*b* or c at this point or on the arms 2 or 2*a* (FIG. 8). Instead of the extension, it is also possible to provide a recess or an open or closed slot. The extensions or recesses are intended for inserting, pushing in, snapping in or, preferably, horizontally sliding in a retaining element 6 to 9 for a heat exchanger or for a heating or cooling means, so that said element is displaceable during mounting or as a result of thermal expansions. The retaining element 6 to 9 is pushed in laterally with its foot 6. The retaining element 6 to 9 is designed so that a square 12 or round 12*a* heat exchange element (indicated by a dashed line) can be hooked in or inserted. Between hooks 9 and 9*a* of the retaining element 6 to 9 is space for fixing the heat exchanger 12, 12*a* by means of a slide-in part 10*a*. The hooks 9 or 9*a* preferably have teeth or extensions in order to hold the retaining part 10*a* so that it cannot be lost.

The pipe support part 8 or 8*a* or the hooks 9 or 9*a* are always designed in the manner required for retaining a heating means or accessories. This drawing shows a heat exchanger having two water-carrying pipes 11 and a spiral lamella 12*a* (dashed line). A square heat exchanger 12 is drawn with a strongly emphasised outline. The spiral heat exchanger 12*a* may be in two parts, while the square heat exchanger may be in the form of a single part. The support part 8, 8*a* and the claws 9, 9*a* are formed according to the specific version of the heating means, for example by means of hot water or electric power; they may also be snap or clamp retainers, etc. The lower narrow arm 2*a* has a spring extension 17*a*. This extension 17*a* can be inserted into a lower strip part 14 which has a corresponding groove 3*e*. The strip 14 then serves as a support or mounting aid for the retaining part 1 and as the cover panel integrated with the wooden cover 13. The upper arm 2 likewise has a spring extension 17 which can be inserted into a corresponding groove 3*e* in an upper strip 15. The upper strip 15 has, on the wall side, a recess 18*a* or a groove which is formed by a pocket 18 of a slide-in metal sheet 21, 22. A back part A which is screwed to the wall with part 1 by means of screws 9 is also provided between the wall and the wall fastening part 1. The back part A is used as a substrate to achieve a precisely flat surface.

The upper part of the strip 15 has an approximately horizontal support surface 20 for a horizontal support part 20*a* of the slide-in metal sheet which forms the pocket 18. This slide-in metal sheet has a preferably round extension 19 which becomes a horizontal surface. The support part 20*a* or the support surface 20 serves to reinforce this part so that the slide-in metal sheet 21, 22 may be made of a weaker material and serves as a retaining jaw for a facing 19. A continuous or segmented upper cover 16 is mounted on the slide-in metal sheet 21, 22. The space remaining free can be used for a cable 23. If no cable is used, the part 18/19 can be dispensed with and only the slide-in part 21, 22 is inserted into the pocket 8*a*.

The back part A, consisting of plastic or the like, may also have an L-shaped form B. The retaining device 1 with the extensions 17 and 17*a* can then also be left without a screw connection 9, at least in the initial stage of assembly, if the back part A is fastened beforehand to the wall. The retaining device is then easily displaceable.

The wooden front cover has an upper and a lower groove 3*d*. These grooves 3*d* are formed in such a way that, after insertion into the lower hook 3*a*, the upper hook 3 can be hooked in without adjusting the upper hook 3, and the upper hook 3 can then be moved downward in this position in order thus to fix the cover 13.

Figure 4:
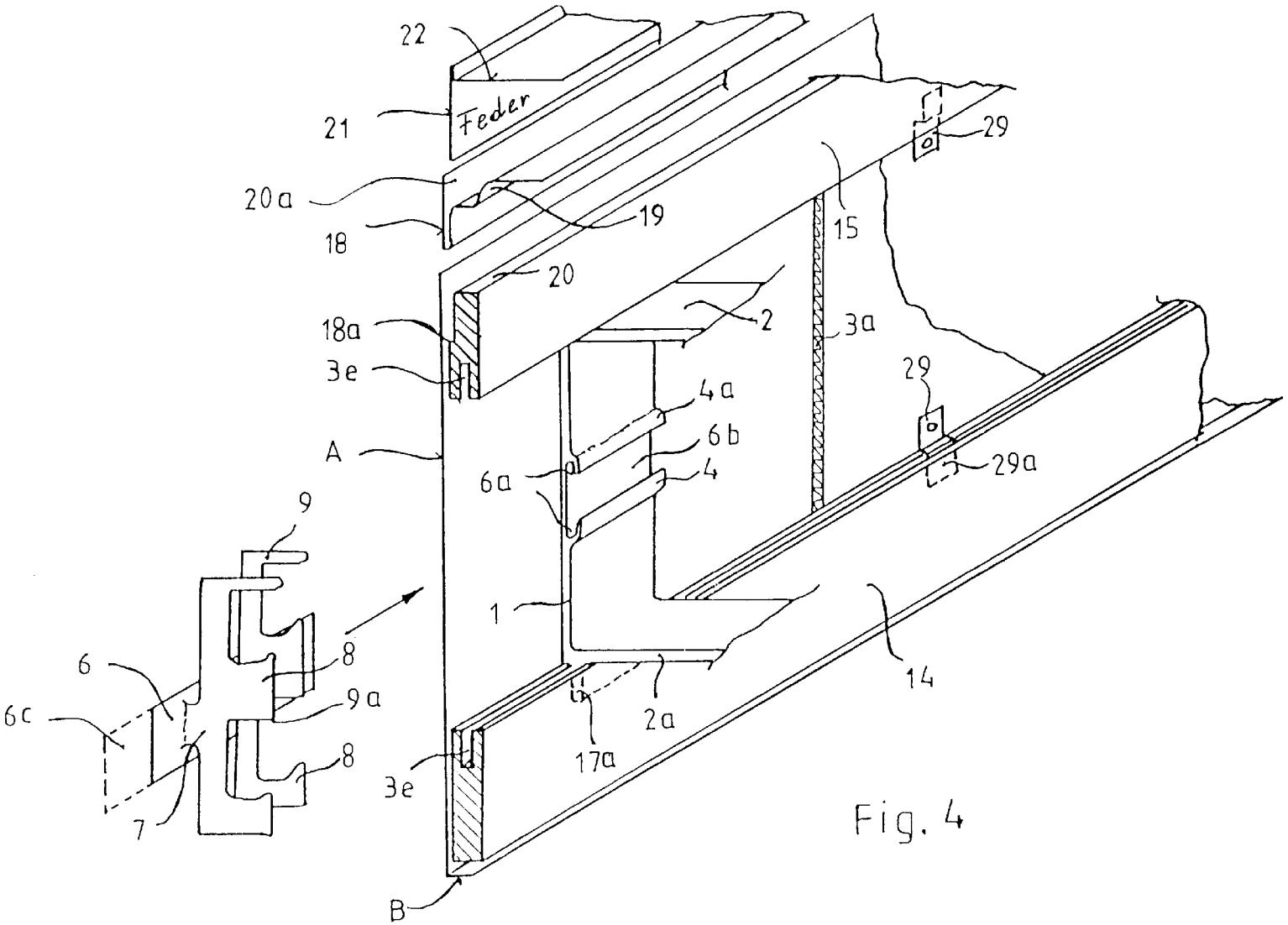
FIG. 4 shows an oblique view of the construction directly on the wall.

The parts shown in FIG. 1, wall fastening part 1, and arms 2 and 2*a* with the hooks 3 and 3*a*, are mounted at intervals (for example 20 to 100 cm), as shown in FIG. 4. The cover 13, the strip parts 14, 15, the upper cover 16, the slide-in parts and 21, 22 and the back part A are continuous and are assembled in modular fashion, preferably by self-construction. The retaining bracket and the slide-in parts 28 may be provided for each arm 2 or may extend continuously over several arms 2. The part 7 with the pipe support part 8 and the hooks 9 and 9*a* is preferably made very thin (sheet metal or wire, etc.) in order to hold the pipe 11 between the lamellae without having to remove heat exchanger lamellae. The pipe support part 8 and the hooks 9, 9*a* can, if required, be made oblique, or at least the part 8. In the case of thin retaining parts 7 to 9, spiral heat exchanger pipes can be pushed by turning.

An inserted angled retaining bracket 28, 28*a* of sheet metal is inserted or mounted below the upper and lower hooks 3 and 3*a* or adhesively bonded (fast-setting adhesive), this retaining bracket 28, 28*a* increasing the size of the fastening surface on the cover 13, i.e. the shim part 28, 28*a* is broader or deeper than the support surface 3 and 3*a* or 3*c* and 27. As a result of this measure, the retaining part 1, 2, 2*a* and the hooks 3 and 3*a* can be made relatively narrow, increasing the size of the convection opening for the heat exchanger 12, 12*a*. This results in a three-point support, which is enlarged by the retaining bracket 28, 28*a*. Longitudinal shifts between the hooks 3, 3*a* and the brackets 28, 28*a* are possible, if not or made from one piece.

The retaining means 6 to 9 at the top and the retaining means at the hook 9*a* at the bottom may also be staggered and may have a clamp or snap means or the like. The retaining element 7 may also be inserted or hooked in, etc. Such alternatives are also indicated by way of example in FIG. 13, where the foot part 6 is held at the top in arm 2. The retaining part 7 has snap retainers 8*b* for forward-flow and return pipes 11, to which the heat exchanger is connected (heat exchanger 12 may be suspended completely therefrom and has no further support). In the case of the part 7 shown, however, a lower retaining means 7*a*, which grips between heat exchanger lamellae, can be seen (the heat exchanger 12 may alternatively also be supported on the lower arm 2*a*). The part 7 simultaneously serves as a frontal fastening surface for electrical means, such as heaters, forward-flow and return controllers, temperature sensors, etc. It may also be longer than shown and may have corresponding retaining elements. The hooks 3 and 3*a* are also formed for retaining a support plate or surface, which in turn holds, clamps or is connected to a wooden cover 13. Hooks 3 and 3*a* may have, in the upper surface, a point-like or continuous groove or extension, in order to snap into a bead 28*e*, FIG. 7, or to lock and therefore to clamp with it.

Both hooks 3 and 3a may also be nondisplaceable but—optionally with their arm—resilient and may retain the wooden cover 13 merely by snapping on.

Figure 2:
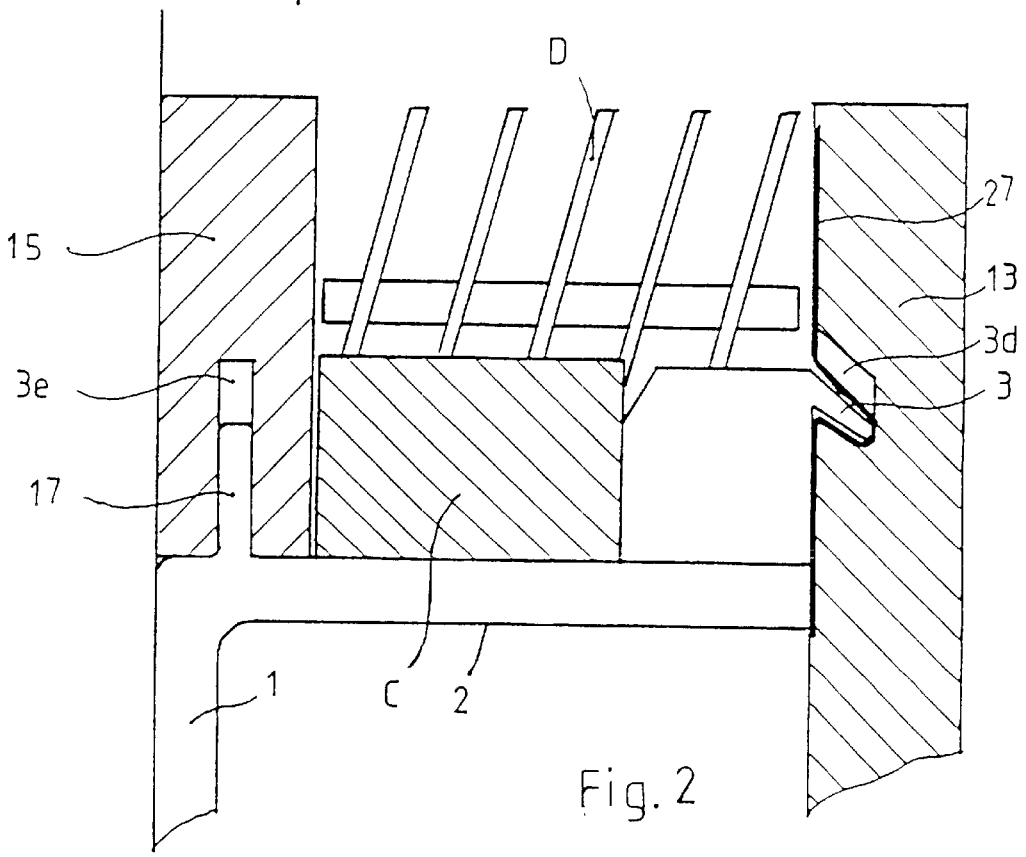
FIG. 2 shows the upper part on a larger scale.

FIG. 2 shows the arm 2, the hook 3, the cover 13 and the retaining means 1 with the spring extension 17, which is inserted into a groove 3*e* in an upper strip 15. This strip 15 has no pocket 18*a* (FIG. 1) but forms a border for a blow-off grid D which is inserted between the strip 15 and the cover 13. A block C (spring/sheet metal part, etc.) mounted on the arm 2 holds the grid D in the desired position. This part may also be in the form of a single piece with the arm 2 or may be capable of being inserted by snap or slide connections. The strip 15 may also be lower so that the grid extends as far as the wall, although this is not preferred owing to the discoloration of the wall by dust. A groove 3*c* for the insertion of a further retaining device 1 may be formed in the upper surface of the upper strip part 15, so that the lower spring extension 17*a* (FIG. 4, FIG. 1) engages the groove. Thus, two heating strips according to the invention would be arranged one above the other. This may be continued as desired in an upward direction so that it is also possible to provide extensive wall heating means by means of the baseboard heating means according to the invention.

Figure 3:
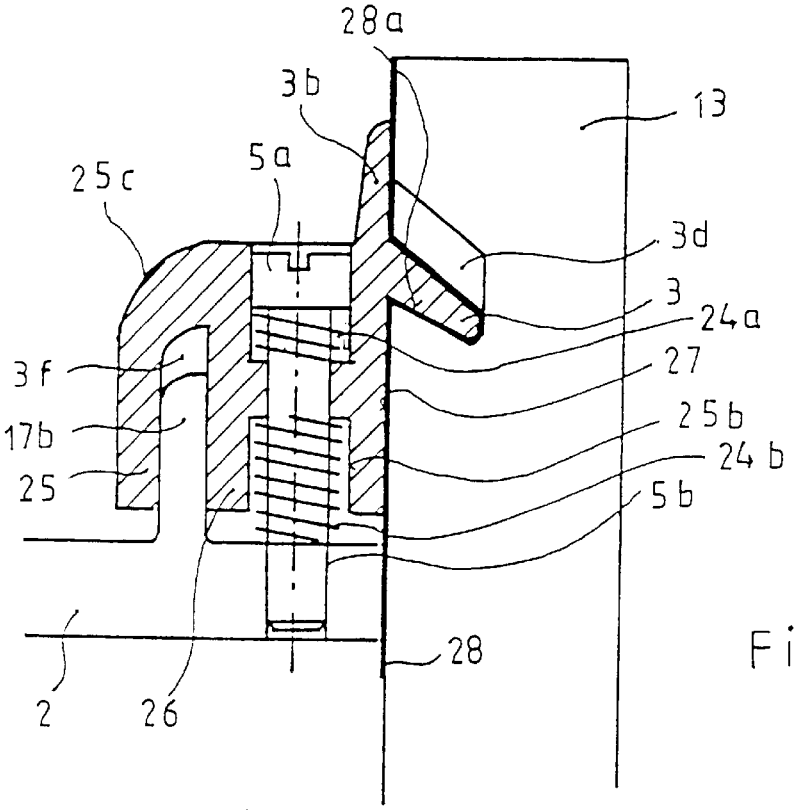
FIG. 3 shows a retaining clip in the upper part, further magnified.

FIG. 3 shows an upper arm 2 and an upper hook 3 which is adjustable in height. A lower spring 24*b* in a bore or in a continuous groove 25*b* presses the hook 3 upward so that the hook 3 does not fall down prior to mounting of the wooden cover 13 and secure and rapid mounting is possible. After engagement of the hook 3 or of the retaining bracket 28 with the hook 3 in the groove 3*d*, a screw 5*a* is tightened and presses against the spring 24*a* which compensates the force of the spring 24*b* and presses the hook 3 downward in the groove 3*d*. In the groove 25*b*, there is still sufficient play to permit slight shrinkages or expansions of the cover 13, and of course the springs 24*a* and 24*b* may also have different dimensions with regard to strength.

The enlarged extension 3*b* offers a vertical support surface for the upper part of the cover 13 or of the bracket 28. A web 17*b* is formed continuously on the arm 2. This web 17*b* is guided in the groove 3*c* or between parts 25 and 26. However, the opposite is also possible. Point-like webs, pins, etc. may also provide support.

Figures 5, 5A:
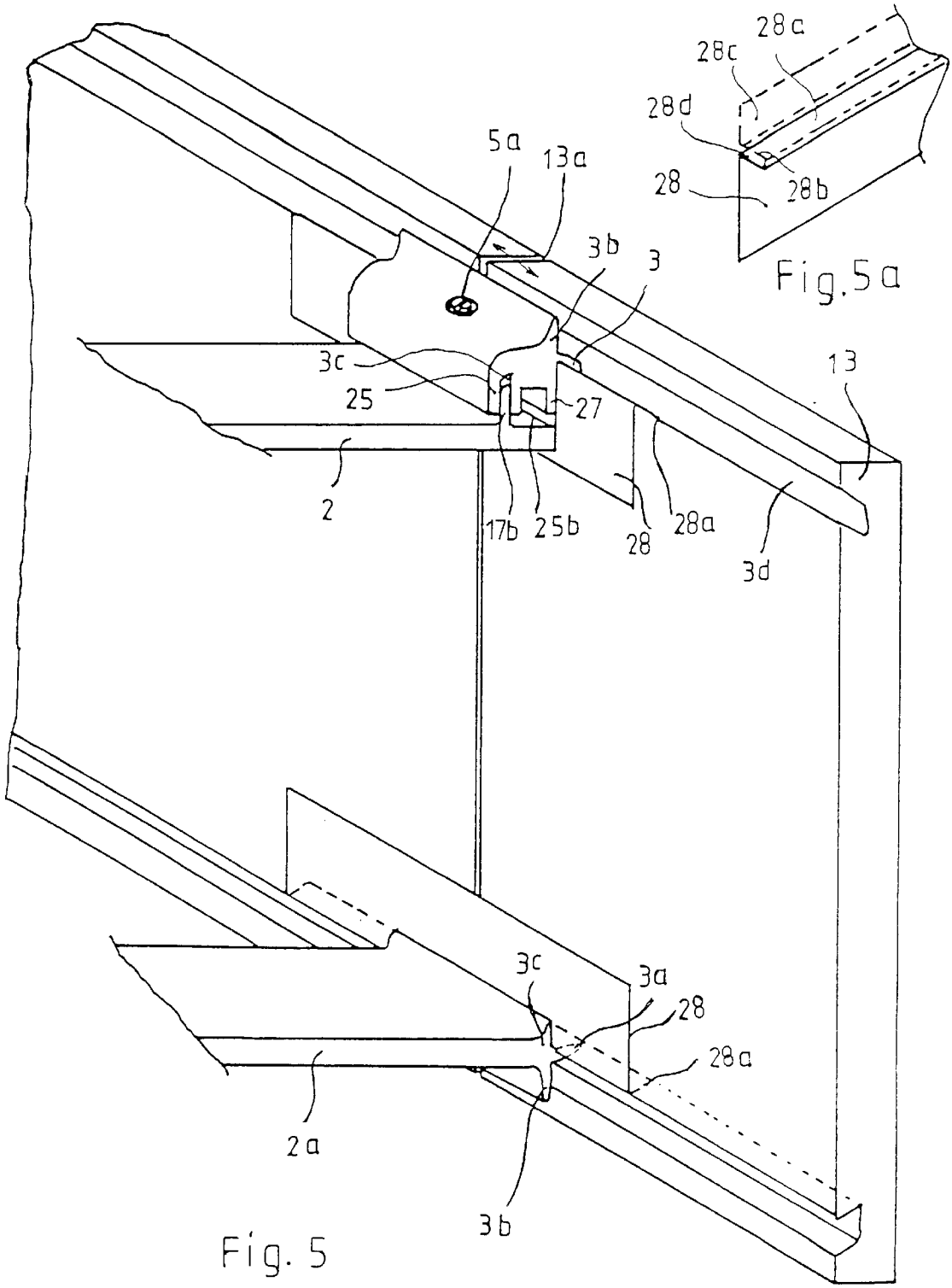
FIG. 5 shows an oblique view of the wooden cover with its fastening, viewed from the direction of the wall.
FIG. 5*a* shows a retaining bracket.

The shim in part 28, 28*a* is emphasised in the drawing (detailed drawing in FIG. 5*a* or explanation for FIG. 1). The visible part 25*c* is made smaller by being rounded. The screw 5*a* may also be turned by means of a screwdriver after mounting of the upper cover 16 or of a facing, with the result that installation in wall claddings, cupboard claddings, bath tub claddings, etc. is also possible.

The movable hook 3 with the two springs 24*a* and b may also be divided so that each spring 24 is held in one part and, preferably, the part with the hook 3 is movable and the lower part has, at the bottom or side, a groove or a web which is guided in a corresponding web or in a corresponding groove of the arm 2 or of a support plate for the cover.

FIG. 4 shows a lower strip 14 and an upper strip 15 in the state prior to mounting. A back part A which is preferably fastened beforehand and has a support foot B is located behind said strips. A pocket 18 in metal sheet 20*a* may be inserted between the strip 15 and the back part A. Stepped fastening parts 29, 29*a* are inserted into the grooves 3*e* and fastened to the wall by means of screws. A wall fastening means 1 with arms 2 and 2*a* is likewise inserted into the grooves 3*e* with their extensions 17 and 17*a*. This permits displacement during mounting and, after checking of the position of the fastening means, the latter is fixed to the wall by means of screws. The retaining element 6 to 9 with its foot 6 is inserted horizontally into the rail-like embodiment 4 or 6*a*, 6*b*; an opposite embodiment is also possible. The foot 6 may also be extended, i.e. the heat exchanger fastening means can, if required, also be located outside the region of the retaining means and wall fastening means 1. The foot 6 or 6*c* may also lead from one wall fastening part 1 to an adjacent wall fastening part 1 and may have additional fastening facilities or holes.

A slide-in part 18 is pushed into the recess 18*a* of the upper strip 15, after which the L-shaped part 21, which is connected continuously or at points to the upper cover 16 (FIG. 1), is pushed in. The foot 6 or 6*c* is guided in an upper or lower groove. Between the upper and lower strips 14 and 15, there is space for a heat insulation 30, which is mounted, if required, for preventing heat loss, without restricting the convection space. It may have the same cross-section everywhere along the baseboard heating.

At least one retaining part 7 may be mounted on a foot 6 or extended foot 6*c*, inside the spatial extension of fastening part 1 or outside it; different and replaceable, combinable retaining parts for different heating accessories or heat exchangers, for example for electric heaters, may be mounted on both sides of the parts 6 or 6*c*, and may also be adjustable relative to one another.

The retaining part 6 to 9 corresponds to that in FIG. 1 but is in duplicate. A single form is possible.

The grooves 6*a* or 6*b* or extensions 4 can also be formed on the upper arm 2 (FIG. 8) and/or on the lower arm 2*a*. The foot 6 or 6*c* can also be in the form of a retaining part or mounting part or surface.

A point-like or continuous bead or grain may be formed on the rear left part of the slide-in part 18/20*a*/19 in the region of the cable space, which bead or grain can be snapped in and fixed in an approximately corresponding bead on part 21 when this part is pushed into the slide-part 18, and can be pulled out again only by overcoming this fastening. Such a fastening is provided by a bead on the perpendicular right part in the region of the facing 15, an approximately corresponding recess being provided in the facing 15. By pushing in the part 21, which approximately fills the part 18, fixing of all parts is achieved. If the slide-in part 21/22 is made of, for example, sheet metal or plastic, the part 21 can be in the form of a spring, as is indicated by a dashed line in FIG. 4.

FIG. 5 shows a butt joint 13*a* between two abutting wooden covers 13 which are held by a relatively narrow wall fastening part 1 with arms 2, 2*a* and hooks 3 and 3*a*. The support surface of the hooks 3 and 3*a* or of the support surface 27 at the top (or 27*a*, FIG. 7) and support surface 3*c* is enlarged according to the invention—preferably by a factor of 2—by inserting an angled or preferably thin retaining bracket of spring metal sheet 28, 28*a* (for example 0.05 to 0.5 mm thick) (FIG. 5*a*) which is larger than the arms 2, 2*a*. This retaining means may therefore be made relatively narrow. A retaining means with bracket 28, 28*a* for two covers 13 is also sufficient. If the arms 2, 2*a* were to be broader, they would hinder the convection. By this retaining means according to the invention, it is possible for covers to shrink or expand slightly, as indicated by butt joint 13*a* with double arrow. This inserted retaining bracket 28 may also be used only with one upper hook 3, for example when the lower hook 3*a* is continuous.

17*b* denotes a continuous web which may also be point-like only in the region of the screw 5*a*. The web is guided in a groove 3*c* of the hook 3. The groove 25*b* is formed in a continuous manner but may also be provided in point-like form only in the region of the screw 5*a*.

FIG. 5*a* shows the retaining bracket 28 or 28*a* with a groove 28*d* and an extension of the part 28*a* to 28*b* and an optional support surface 28*c*. The groove 28*d* is formed so that it can be pushed like a bracket onto a hook 3 or 3*a* and holds through gentle clamping. This saves mounting or adhesively bonding the part and makes installation considerably easier. The groove 28*d* may also be provided only in the region of the hook 3. Clamping may also be effected by marks or point-like or continuous beads on the surface 28*b* in the region of the hook 3 (FIG. 7; 28*e*).

FIG. 6 shows a retaining device 7 with web 6 according to FIG. 1 from the front. Two thin sheet metal retaining parts are shown. The lamellae 12 and the pipe 11 are indicated.

This Figure shows the retaining part 7 between the lamellae 12 of the heat exchanger. There is therefore no need to remove any lamellae. However, it is possible to mount a further support surface or retaining means for the heat exchanger or accessories, depending on the design of the heat exchanger or accessories. Here, the foot 6 or 6*c* is of course broader than the retaining parts 7, which permits any displacement or fastening of the parts, including outside the wall fastening part 1 in FIG. 1.

FIG. 6*a* shows that the parts 7 and 9 may also be staggered relative to one another and may be formed so that they are oblique or combinable or coiled identically to a spiral tubular heat exchanger 12*a*, which permits displacement by turning of the pipe 11 in the case of round spiral heat exchangers 12*a*. 10*a* denotes a shim (clamping part) between hook 9 and lamella 12*a* for clamping the heat exchanger.

FIG. 7 shows an upper arm 2 of a wall fastening part 1. Here, the hook 3, 26 is guided between webs 17*b* and 17*c*. The front part of the web 17*c* forms support surface 27*a* for the retaining bracket 28 which in this variant too can be pushed on. The retaining bracket 28 is thus used for a very wide range of hook designs. It may be formed from spring sheet metal, metal, plastic, etc. Point-like or continuous beads 28*e* in the groove 28*b* effect, in addition to clamping, a snap connection to the hook 3 or 3*a*, which has a point-like or continuous groove or bead 28*f* for this purpose.

FIG. 8 shows the variant of a wall fastening part 1*a* with an upper arm 2*b*, the retaining element 7*a* being guided on the latter on projections 4*b* and 4*c*. In addition to this variant, the lower arm 2*a* and the free end of the upper arm 2*b* are also differently designed. The hooks 3*g* and 3*h* are formed as a single piece with the arms 2*b* and 2*c*, respectively, and serve for suspending a sheet-like retaining bracket 28*g* which in turn is connected to a wooden cover 13 or the like and has certain latitudes for expansion at the hooks 3*g* and 3*h*.

Figure 9:
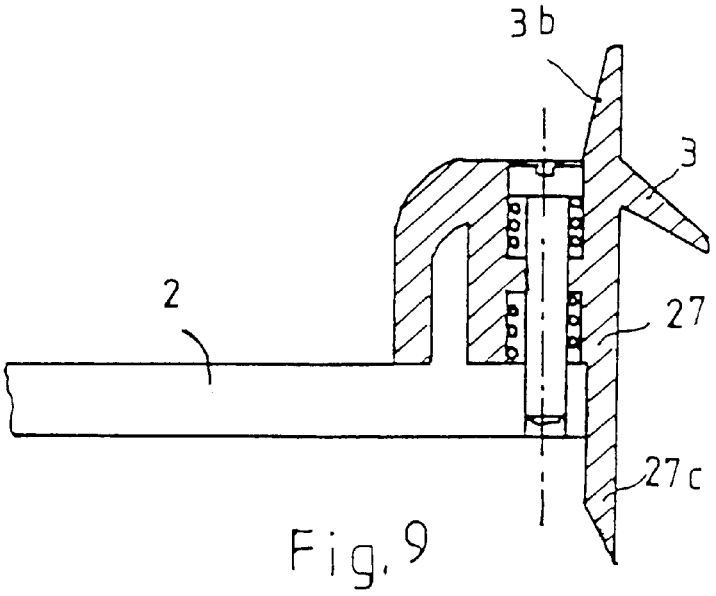

FIG. 9 shows the upper arm 2 of a wall fastening means 1 and a movable hook 3 (as in FIG. 3) in detail. In the case of this variant, the part 27*c* is lengthened. Here, the hook 3 with 3*b*, 27, 27*c* is preferably twice as broad as the arm 2 and is rounded on all sides so that it can slide and thus perform the sliding function of the retaining bracket 28, which may be dispensed with here.

Figure 10:
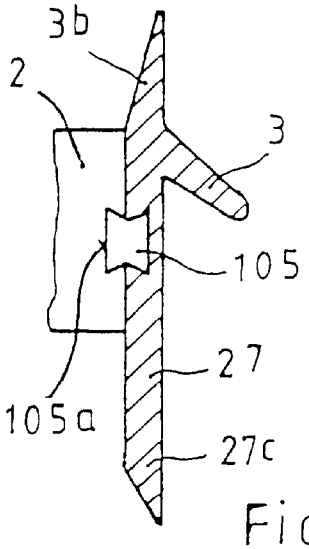

FIG. 10 shows an upper hook 3 which is inserted laterally into arm 2 by means of a swallowtail guide 105, 105*a*. The extension or groove is accommodated either in the part 27 or in the arm 2. In this variant, the hook 3 must once again be broader (cf. FIG. 9). A sliding function of the retaining bracket 28 may in this case be performed by the swallowtail guide 105, 105*a*. Instead of this being fastened directly to the arm 2, it may also be held, for example, on a part 26 according to FIG. 7 (FIG. 10).

Figure 11:
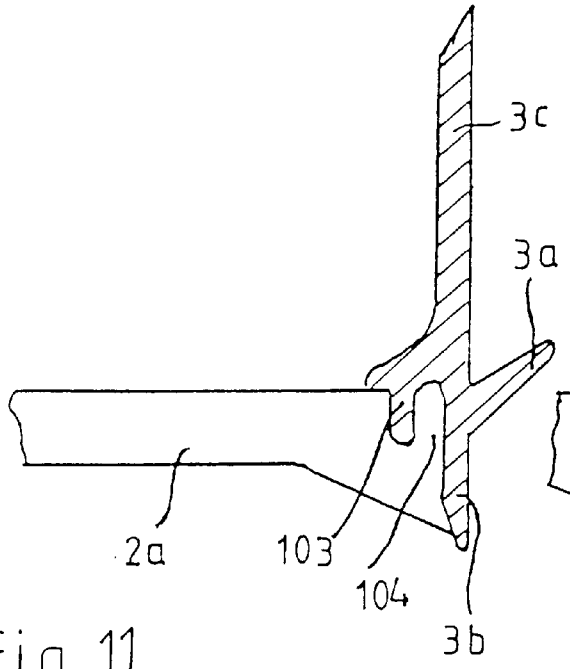

FIG. 11 shows an arm 2*a* with an extended support part 3*c* (at least twice as high as the cross-section of the arm 2*a*). The support part has at least one extension 103 and is inserted into at least one groove 104 in the arm 2*a*, and the groove of the extension may be accommodated either in the support or in the arm or in both together. The support surface 3*b* has a direct support surface for arm 2*a*. The connection may also be such that the support part can be pushed in laterally.

Figure 12:
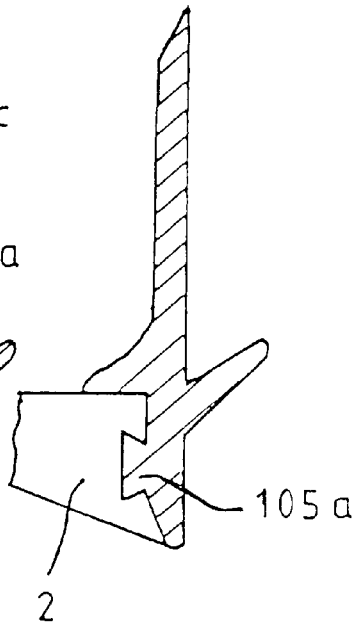

FIG. 12 shows an embodiment in which the support part 3*c*, 3*a*, 3*b* is laterally inserted directly into the arm 2*a* by means of a swallowtail guide 105*a*, and the extension or the groove may be made in the support part 3*c*, 3*a*, 3*b* or in the arm 2.

Figure 16:
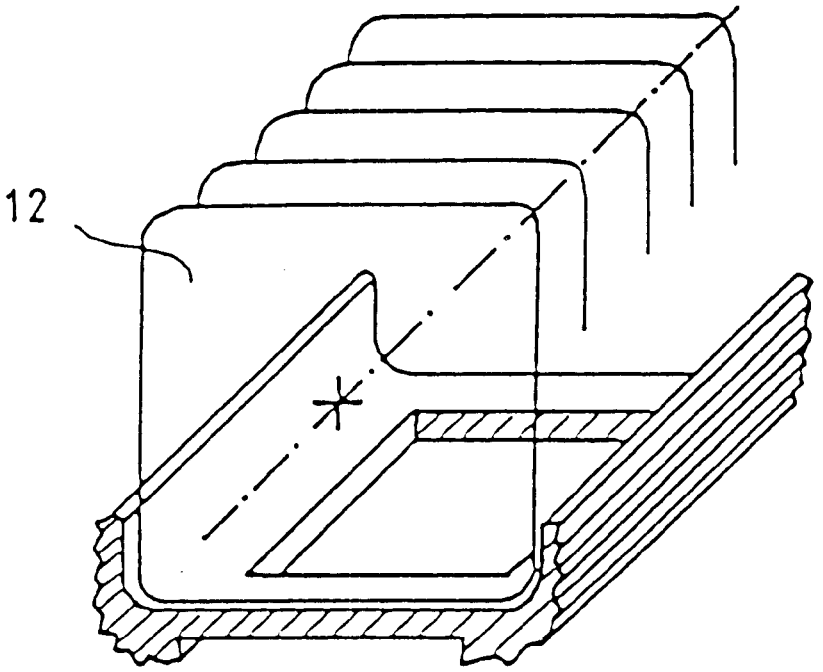
Figure 17:
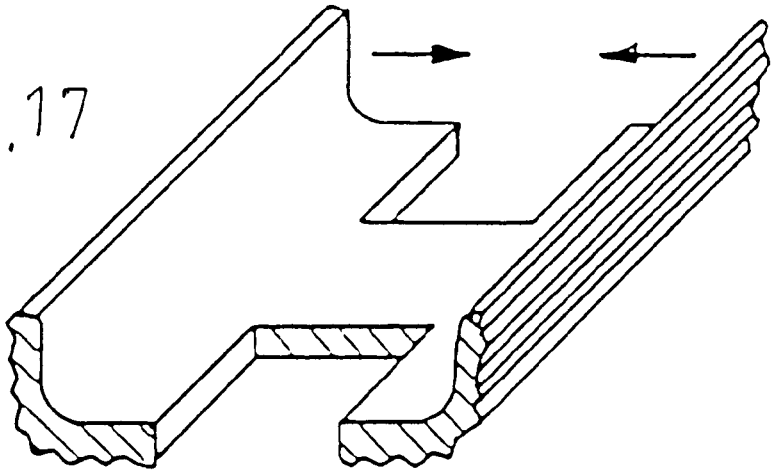

FIGS. 14 to 17 show details of possible variants of baseboard heating means according to theinvention, in which the heat exchanger is supported on the wall fastening part 1 by means of a support part. This serves to reduce noise in the case of any expansions or longitudinal displacements of the heat exchanger 12 relative to the retaining part 1. The support part can be snapped onto part 1 by means of the webs or the like (FIGS. 14, 15) or can be clamped on the heat exchanger 12 (FIGS. 16, 17). In order to hinder the heat circulation as little as possible, the support parts may also have recesses (FIGS. 16, 17). Furrows in the support part facilitate longitudinal displacements.

I claim:

1. An extensive temperature-maintaining device having at least one wall fastening part (1) with an upper and a lower narrow arm (2) and connecting means (3) arranged thereon for at least one temperature-maintaining heating or cooling element (12), wherein the connecting means (3) are formed for retaining an extensive cover (13) which, in a position for use, is a distance away from the temperature-maintaining element (12), and wherein a retaining and sliding bracket (27; 28) is provided between at least one arm (2) or its connecting means (3) and the extensive cover (13), which bracket increases the size of a fastening surface between the arm (2) and the connecting means (3) in relation to the cover (13) by a corresponding broader and/or deeper and/or higher form in relation to a form of the arm (2) or connecting means (3), so that, at least a slight displacement of the cover (13) due to natural expansion or shrinking is possible relative to the arm (2) and independently of the temperature-maintaining element (12), the retaining and sliding bracket being eventually formed as a single piece with the connecting means.

2. A temperature-maintaining device as claimed in claim 1, wherein the retaining and sliding bracket is in the form of a retaining bracket (28) which is formed to correspond to the connecting means (3), and substantially exceeds the width of said connecting means and together with the connecting means (3) engages a groove (3d) in the cover (13), and the retaining bracket (28) comprises a profiled rail of plastic or metal or of a metal sheet, and may be connected to the cover (13).

3. A temperature-maintaining device as claimed in claim 2, wherein the retaining bracket (28; 28*g;* 27) and/or the connecting means (3) each form a support for the cover (13) above and/or below, so that the cover can be clamped to an upper or lower arm (2) by the connecting means (3) in a groove (3*d*) at three points.

4. A temperature-maintaining device as claimed in claim 3, wherein the retaining bracket (28) is formed to correspond to the groove (3*d*) in a region of the connecting means (3) and can be firmly clamped or bonded therein.

5. A temperature-maintaining device as claimed in any of the preceding claims, wherein the retaining bracket (28) and the connecting means (3) have protuberances, grooves, or beads (28*f*) for mutual interlocking.

6. A temperature-maintaining device as claimed in claim 1, wherein the retaining and sliding bracket is in the form of a retaining bracket having a swallowtail (105, 105*a*) or a groove and feather shape (103, 104) in section and permits a displacement in the longitudinal direction of the cover (13), the swallowtail (105, 105*a*) or the groove and feather shape (103, 104), respectively, being arranged between the connecting means(3), which engages a groove (3*d*) in the cover (13), and the arm (2).

7. A temperature-maintaining device as claimed in claim 1, wherein the retaining and sliding bracket is in the form of a retaining bracket (28*g*) having a sheet metal-like longitudinal extension in relation to the cover (13), hook-like springs (3*i*) which can be interlocked with corresponding connecting means (3*g*, 3*h*) on the arms (2*b*, 2*a*) projecting in an upper and lower region of the retaining bracket.

8. A temperature-maintaining device as claimed in claim 1, wherein the connecting means (3) is held under spring load (24) on the arm (2).

9. A temperature-maintaining device as claimed in claim 8, wherein an initial tension of the spring load (24) and a position of the connecting means (3) relative to the arm (2) is adjustable by means of a screw (3*f*, 17*b*).

10. A temperature-maintaining device as claimed in claim 8, wherein the connecting means (3) can be guided laterally on the arm (2) by means of a plug-in connection (26, 17*b*, 17*c*).

11. A temperature-maintaining device as claimed in claim 1, wherein the wall fastening part (1) has, at its end facing the wall, a spring extension (17*a*, 17) at least at its bottom and at its top, for engaging a groove (3*e*) in upper and lower wooden facings (14, 15), wherein at least the lower wooden facing (14) is fastened invisibly to the wall and serves as a mounting template for the fastening part (1) and the upper wooden facing (15) serves for fastening and/or delineating or supporting air grids and where eventually a block (C) is located between the facing (15) and the connecting means (3) or cover (13) respectively, said block (C) serving as support.

12. A temperature-maintaining device as claimed in claim 11, wherein an intermediate space between the upper and lower facings (15, 14) are capable of being provided with a heat insulation (30).

13. A temperature-maintaining device as claimed in claim 1, wherein the wall fastening part (1, 2) has a retaining means (4) for sliding in a retaining part (6–9) for the heating or cooling element (12, 12*a*) or accessories, the retaining part (6–9) having at least one narrow pipe support part (8) which can be placed between heat-conducting lamellae of the heating or cooling element (12, 12*a*).

14. A temperature-maintaining device as claimed in claim 1, wherein a wall fastening part (1) is kept a distance away from the wall over the major part of its height by means of webs, or protuberances, an extensive back part (A) being fastened beforehand with a lower support foot (B) between the wall and fastening part (1).

15. A temperature-maintaining device as claimed in claim 1, wherein at least one retaining element on at least one of the arms (2) is formed as a single piece.

16. A temperature-maintaining device as claimed in claim 1, wherein a lower arm (2*a*) forms a support surface having sliding properties for the heating or cooling element (12) or accessories.

17. A temperature-maintaining device as claimed in claim 1, wherein the lower arm (2*a*) is formed for cooperation with the heating or cooling element (12) equipped with cams.

* * * * *